US006235999B1

(12) United States Patent
Rübenach

(10) Patent No.: US 6,235,999 B1
(45) Date of Patent: May 22, 2001

(54) APPARATUS FOR ADVANCING AND WEIGHING TEXTILE FIBERS

(75) Inventor: Bernhard Rübenach, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/267,402

(22) Filed: Mar. 15, 1999

(30) Foreign Application Priority Data

Mar. 14, 1998 (DE) ..... 198 11 143

(51) Int. Cl.[7] ..... G01G 13/02; G01G 13/04; D01G 15/40

(52) U.S. Cl. ..... 177/116; 177/121; 19/105

(58) Field of Search ..... 19/105, 200, 203, 19/204, 205; 177/16, 116, 121

(56) References Cited

U.S. PATENT DOCUMENTS

| | | | | |
|---|---|---|---|---|
| 4,133,455 | * | 1/1979 | Moser | 222/77 |
| 4,206,823 | * | 6/1980 | Krull | 177/121 |
| 4,689,857 | * | 9/1987 | Pinto | 19/105 |
| 4,742,879 | * | 5/1988 | Leifeld | 177/50 |
| 4,811,463 | * | 3/1989 | Leifeld | 19/105 |
| 5,337,455 | * | 8/1994 | Pinto et al. | 19/105 |
| 5,365,640 | * | 11/1994 | Sterin | 19/200 |
| 5,575,039 | * | 11/1996 | Leiford et al. | 19/105 |
| 5,586,365 | | 12/1996 | Leifeld et al. | 19/105 |
| 5,950,282 | * | 9/1999 | Pinto | 19/97.5 |
| 6,085,389 | * | 7/2000 | Brabant | 19/105 |

FOREIGN PATENT DOCUMENTS

| | | | |
|---|---|---|---|
| 2 111 404 | | 9/1972 | (DE) . |
| 42 12 997 | | 10/1993 | (DE) . |
| 2266598 | * | 11/1993 | (GB) ..... 19/105 |

* cited by examiner

*Primary Examiner*—Randy W. Gibson
(74) *Attorney, Agent, or Firm*—Venable; Gabor J. Kelemen

(57) ABSTRACT

An apparatus for feeding and weighing textile fibers includes a weighing scale container having an open end chargeable with fiber material; an upper feed chute having an upper end chargeable with fiber material and a lower end; a withdrawing roll obturating the lower end; a first drive for slowly rotating the withdrawing roll; a feed tray cooperating with the withdrawing roll and defining a nip into which fiber material is drawn from the upper feed chute and from which the fiber material is discharged; an opening roll arranged immediately at the nip for receiving the fiber material discharged from the nip; a second drive for rapidly rotating the opening roll for tearing fiber material from the nip and for opening and discharging the fiber material; a lower feed chute having an upper end receiving fiber material discharged from the opening roll and a lower end; a movable shutoff gate situated at the lower end of the lower feed chute for opening and closing the lower feed chute; and a third drive for moving the shutoff gate.

7 Claims, 2 Drawing Sheets

APPARATUS FOR ADVANCING AND WEIGHING TEXTILE FIBERS

CROSS REFERENCE TO RELATED APPLICATION

This application claims the priority of German Application No. 198 11 143.6 filed Mar. 14, 1998, which is incorporated herein by reference.

BACKGROUND OF THE INVENTION

This invention relates to an apparatus for advancing and weighing textile fibers, particularly cotton and chemical fibers wherein two feed chutes are serially superpositioned above a weighing container and are charged with fiber material. The upper feed chute has a bottom opening in which a slowly rotating withdrawing roll is disposed which cooperates with a counterelement, while the lower feed chute has a bottom opening controlled by a gate. A rapidly rotating opening roll is arranged downstream of the withdrawing roll and the counterelement, as viewed in the direction of fiber advance.

In a known apparatus the upper feed chute is closed off at its lower end by two slowly rotating withdrawing rolls, and a rapidly rotating opening roll is arranged downstream of the withdrawing rolls. The lower feed chute is charged with fiber by means of the two withdrawing rolls and the after-connected opening roll. It is a disadvantage of such a prior art apparatus that the nip between the two withdrawing rolls has an appreciable distance from the opening roll. The rapidly rotating opening roll tears the slowly advancing fiber material from the nip. Due to the remoteness of the nip from the opening roll, only the relatively long fibers are caught by the opening roll and thus only appreciably coarse fiber tufts are formed. As a result, the metering accuracy of the apparatus is limited. It is a further drawback that the use of two withdrawing rolls is structurally and systemwise complex.

SUMMARY OF THE INVENTION

It is an object of the invention to provide an improved apparatus of the above-outlined type from which the discussed disadvantages are eliminated, which is structurally simple and which makes possible an improved metering accuracy for the fiber material.

This object and others to become apparent as the specification progresses, are accomplished by the invention, according to which, briefly stated, the apparatus for feeding and weighing textile fibers includes a weighing scale container having an open end chargeable with fiber material; an upper feed chute having an upper end chargeable with fiber material and a lower end; a withdrawing roll obturating the lower end; a first drive for slowly rotating the withdrawing roll; a feed tray cooperating with the withdrawing roll and defining a nip into which fiber material is drawn from the upper feed chute and from which the fiber material is discharged; an opening roll arranged immediately at the nip for receiving the fiber material discharged from the nip; a second drive for rapidly rotating the opening roll for tearing fiber material from the nip and for opening and discharging the fiber material; a lower feed chute having an upper end receiving fiber material discharged from the opening roll and a lower end; a movable shutoff gate situated at the lower end of the lower feed chute for opening and closing the lower feed chute; and a third drive for moving the shutoff gate.

The sole withdrawing roll provided at the lower end of the upper feed chute according to the invention serves a dual function: it withdraws the fiber material from the upper feed chute and—in cooperation with the feed tray—functions as a feed roll for advancing fiber material to the opening roll. The use of an apparatus which has only a single withdrawing roll cooperating with a feed tray and functioning both as a fiber withdrawing device and a fiber feeding device is structurally simple. The outlet side of the nip between the feed roll and the feed tray is arranged in the immediate vicinity of the opening roll. As a result, even short fibers may be clamped and caught by the opening roll and thus small fiber quantities are caught and opened by the opening roll which means that the latter is capable of forming small fiber tufts. Small fiber tufts improve the accuracy of the metering and thus a more accurate weighing may be achieved and a greater overall precision of the apparatus may be achieved.

The invention has the following additional advantageous features:

The direction of rotation of the withdrawing roll is reversible, whereby a reversible intake is possible for avoiding an "after-run", that is, when the withdrawing roll is stopped, the opening roll does not continue to tear fiber material from the nip.

In operation the directions of rotation of the withdrawing roll and the opening roll are oppositely oriented so that adjoining regions of the rolls move codirectionally.

The opening roll is provided with pins between which gaps are present as viewed axially. Such an arrangement reduces the entrained air stream.

The opening roll has a circumferential speed of approximately 400–600 m/sec. This measure further decreases the entrained air stream.

The opening roll has a diameter of approximately 200–300 mm. This arrangement may further decrease the entrained air stream so that a swirling of the fiber material taken from the withdrawing roll by the opening roll is avoided.

The circumferential speed of the withdrawing roll is adjustable. For such a purpose an rpm-controlled drive motor such as a servomotor may be provided which is connected to an electronic control and regulating device such as a microcomputer.

For providing a fiber mixture, a plurality of devices according to the invention are provided.

In the weighing container different fiber types are introduced.

The feed tray cooperating with the withdrawing roll is stationary.

The feed roll cooperating with the withdrawing roll is radially movable and is, for example, spring loaded.

The nip width between the withdrawing roll and the feed table is adjustable.

The withdrawing roll has a clothing.

The withdrawing roll has a circumferential speed of 1–2 m/min.

DESCRIPTION OF THE PREFERRED EMBODIMENT

Figure 1:
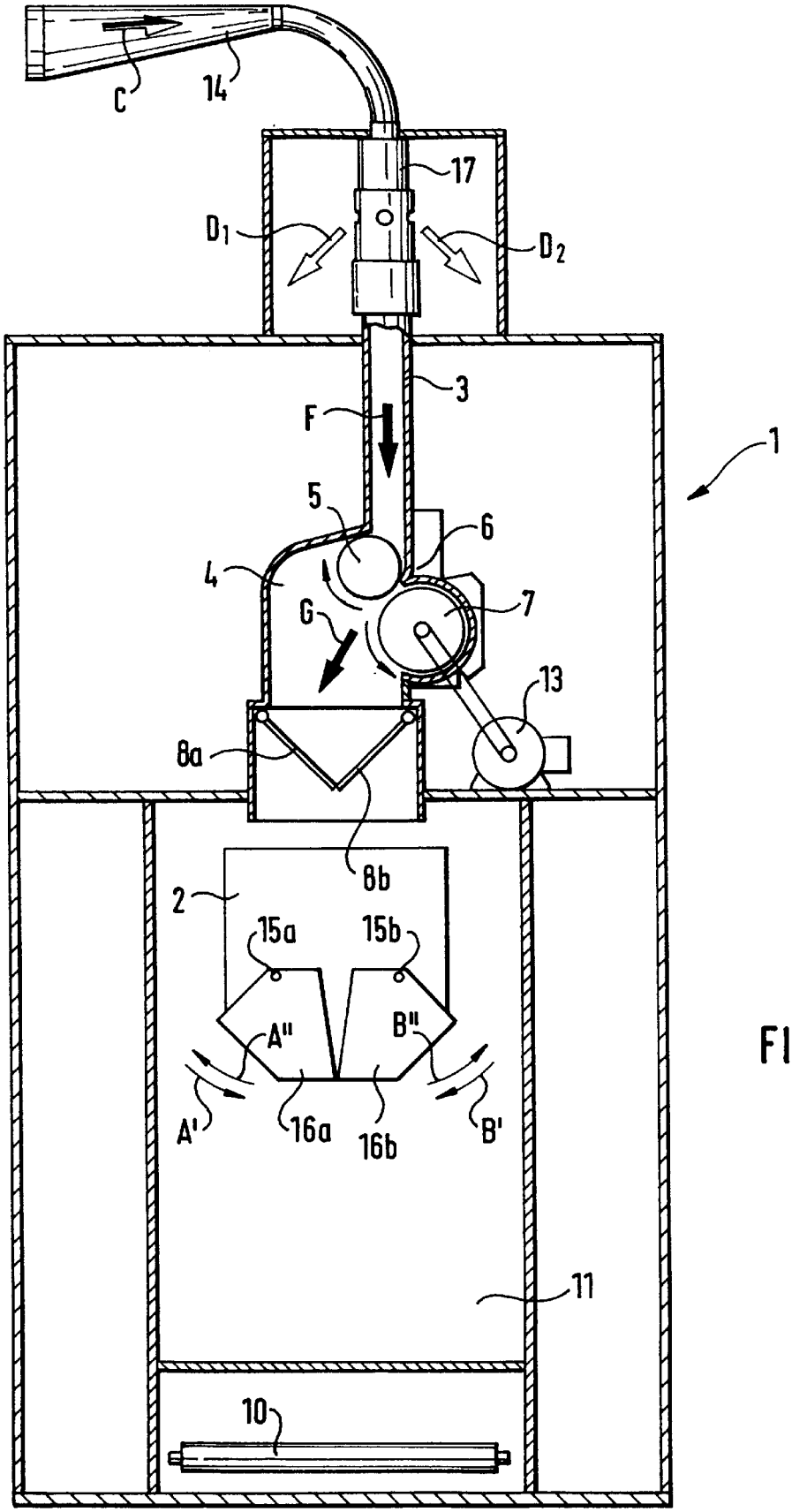
FIG. 1 is a schematic side elevational view of a preferred embodiment of the invention.

FIG. 1 shows a weighing feeder 1 having a weighing container 2 above which two vertically serially superposed feed chutes 3 and 4 are provided. The upper feed chute 3 is supplied with fiber material from a pneumatic duct 14 and has, at its lower end, a controllable, slowly rotating withdrawing roll 5 and a rapidly rotating opening roll 7 positioned therebelow. The withdrawing roll 5 which has a clothing 5*b* functions as a feed roll and cooperates with a feed tray 6. The clothing 7*b* of the opening roll 7 is situated in the immediate vicinity of the outlet side of the nip defined between the withdrawing roll 5 and the feed tray 6. Below the weighing container 2 a conveyor belt 10 is arranged which forms a part of a fiber tuft mixing apparatus 11.

A photocell 17 is arranged in the upper region of the upper feed chute 3 for detecting the fill level therein. The lower feed chute 4 is closed at its lower end by two cooperating gates 8*a*, 8*b* which may be operated, for example, by a pneumatic cylinder 12 and which are rotatable in a respective bearing 9*a*, 9*b*. The weighing container 2 is closed at its lower end by two cooperating gates 16*a*, 16*b* rotatable in the direction of arrows A', A" and, respectively, B' and B" about respective rotary axes 15*a* and 15*b*. The withdrawing roll 5 is driven by a controllable and reversible drive motor 18 such as a d.c. motor, while the opening roll 7 is driven by a motor 13.

In operation, the weighing container 2 is pre-charged in a rapid process (coarse charging) and is subsequently complementally filled in a slow charging process (fine charging).

The photocell 17, the drive motor 18 for the withdrawing roll 5, the drive 12 for the gates 8*a*, 8*b* and the driving device for the gates 16*a*, 16*b* are connected to a non-illustrated common electronic control and regulating device.

Figure 2:
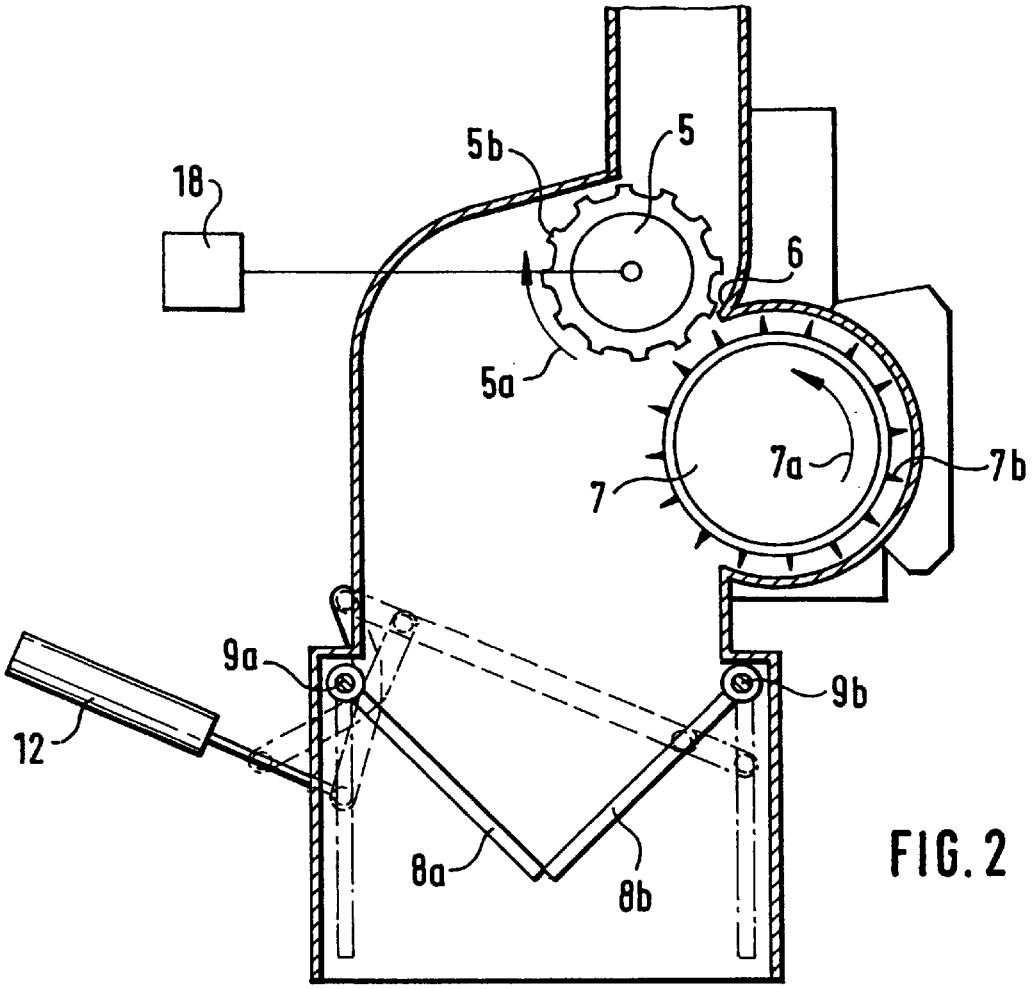
FIG. 2 is a schematic side elevational view of a detail of the structure shown in FIG. 1, illustrated on an enlarged scale.

The directions of rotation of the withdrawing roll 5 and the opening roll 7 are indicated by curved arrows 5*a* and 7*a* in FIGS. 1 and 2. The tuft/air mixture is designated with an arrow C, the separated air streams are designated with arrows $D_1$, $D_2$ and the fiber tufts are designated with arrows F and G.

Figure 3:
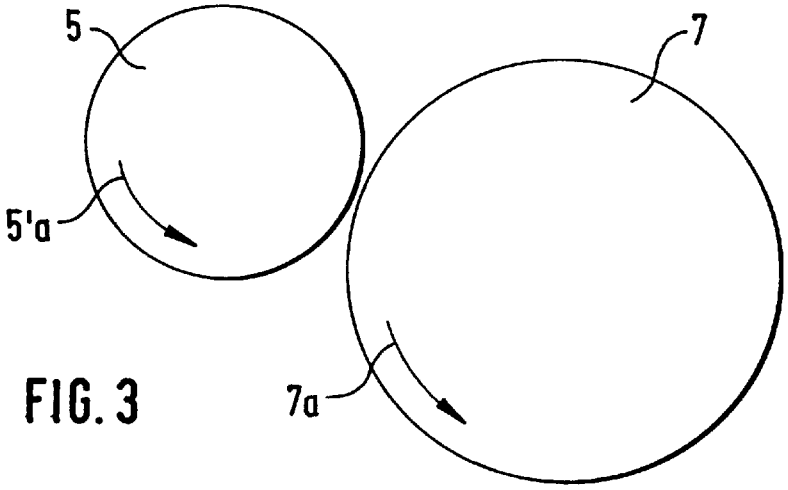
FIG. 3 is a side elevational view showing the cooperation of a withdrawing roll and an opening roll where the withdrawing roll is rotated in a reverse direction.

As shown in FIG. 3, the withdrawing roll 5 is reversed to rotate in the direction of the arrow 5'*a*, while the opening roll 7 rotates in the direction of the arrow 7*a*. Such a reverse rotation of the withdrawing roll 5 ensures that fiber material cannot be torn by the opening roll 7 from the nip in an undesired manner.

It will be understood that the above description of the present invention is susceptible to various modifications, changes and adaptations, and the same are intended to be comprehended within the meaning and range of equivalents of the appended claims.

What is claimed is:

1. An apparatus for feeding and weighing textile fibers, comprising (a) a weighing scale container having an open end chargeable with fiber material;

(b) an upper feed chute having an upper end chargeable with fiber material and a lower end;

(c) a withdrawing roll obturating said lower end;

(d) first drive means for rotating said withdrawing roll;

(e) a feed tray cooperating with said withdrawing roll and defining a nip into which fiber material is drawn from said upper feed chute and from which the fiber material is discharged;

(f) an opening roll arranged immediately at said nip for receiving the fiber material discharged from said nip;

(g) second drive means for rotating said opening roll for tearing fiber material from said nip and for opening and discharging the fiber material;

(h) a lower feed chute having an upper end receiving fiber material discharged from said opening roll and a lower end;

(i) a movable shutoff gate situated at said lower end of said lower feed chute for opening and closing said lower feed chute; said movable shutoff gate being positioned above said weighing scale container for discharging the textile fibers into said weighing scale container when said movable shutoff gate opens said lower feed chute; and (j) third drive means for moving said shutoff gate.

2. The apparatus as defined in claim 1, wherein said first drive means is reversible to reverse rotation of said withdrawing roll.

3. The apparatus as defined in claim 1, wherein said opening roll has a clothing composed of pins having gaps therebetween as viewed axially parallel to said opening roll.

4. The apparatus as defined in claim 1, wherein said opening roll has a diameter of approximately between 200 and 300 mm.

5. The apparatus as defined in claim 1, wherein said first drive means includes means for varying the rpm of said withdrawing roll.

6. The apparatus as defined in claim 1, wherein said feed tray is stationary.

7. The apparatus as defined in claim 1, wherein said withdrawing roll has a clothing.

* * * * *